US008164505B2

(12) United States Patent
Venermo et al.

(10) Patent No.: US 8,164,505 B2
(45) Date of Patent: Apr. 24, 2012

(54) STRUCTURE FOR REDUCING SCATTERING OF ELECTROMAGNETIC WAVES

(75) Inventors: Jukka Venermo, Espoo (FI); Sergei A. Tretyakov, Espoo (FI); Olli Luukonen, Helsinki (FI); Pekka Alitalo, Espoo (FI); Liisi Schulman, Helsinki (FI)

(73) Assignee: Aalto University Foundation, Aalto (FI)

( * ) Notice: Subject to any disclaimer, the term of this patent is extended or adjusted under 35 U.S.C. 154(b) by 40 days.

(21) Appl. No.: 12/663,077

(22) PCT Filed: Jun. 3, 2008

(86) PCT No.: PCT/FI2008/000060

§ 371 (c)(1), (2), (4) Date: Jun. 14, 2010

(87) PCT Pub. No.: WO2008/148929

PCT Pub. Date: Dec. 11, 2008

(65) Prior Publication Data

US 2011/0102098 A1 May 5, 2011

(30) Foreign Application Priority Data

Jun. 4, 2007 (FI) ..... 20070445

(51) Int. Cl.
*H01Q 17/00* (2006.01)

(52) U.S. Cl. ..... 342/1

(58) Field of Classification Search ..... 342/1–4
See application file for complete search history.

(56) References Cited

U.S. PATENT DOCUMENTS

| | | | | |
|---|---|---|---|---|
| 3,833,909 | A | 9/1974 | Schaufelberger | |
| 4,356,462 | A | 10/1982 | Bowman | |
| 4,490,668 | A | 12/1984 | Sterzer | |
| 2004/0227687 | A1 * | 11/2004 | Delgado et al. | 343/872 |
| 2005/0083241 | A1 * | 4/2005 | Zarro et al. | 343/786 |
| 2005/0200540 | A1 | 9/2005 | Isaacs et al. | |
| 2005/0225492 | A1 | 10/2005 | Metz | |

FOREIGN PATENT DOCUMENTS

| | | |
|---|---|---|
| EP | 0 649 227 | 4/1995 |
| EP | 1 135 832 | 12/2005 |
| FI | 924923 | 5/1993 |
| FI | 944849 | 4/1995 |
| FI | 981060 | 11/1999 |
| FR | 2.229.149 | 12/1974 |
| GB | 744615 | 2/1956 |
| GB | 2 251 340 | 7/1992 |
| WO | 2006/015478 | 2/2006 |
| WO | 2006/055798 | 5/2006 |

OTHER PUBLICATIONS

International Search Report dated Oct. 3, 2008, from corresponding PCT application.

* cited by examiner

*Primary Examiner* — Timothy A Brainard
(74) *Attorney, Agent, or Firm* — Young & Thompson

(57) ABSTRACT

A structure made of in certain frequency bands invisible material includes a transmission line network. The structure has a matching layer at the boundary of the material, supporting structures inside the transmission line network and that the transmission line network has been matched with the surrounding space.

16 Claims, 7 Drawing Sheets

*An illustration of the transmission-line network and antenna array, which form an invisible material*

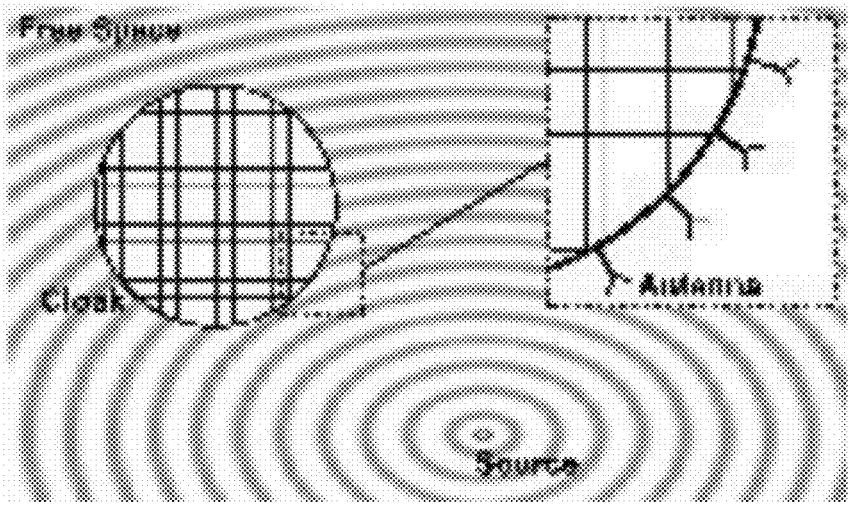
*Figure 1: An illustration of the trasmission-line network and antenna array, which form an invisible material*

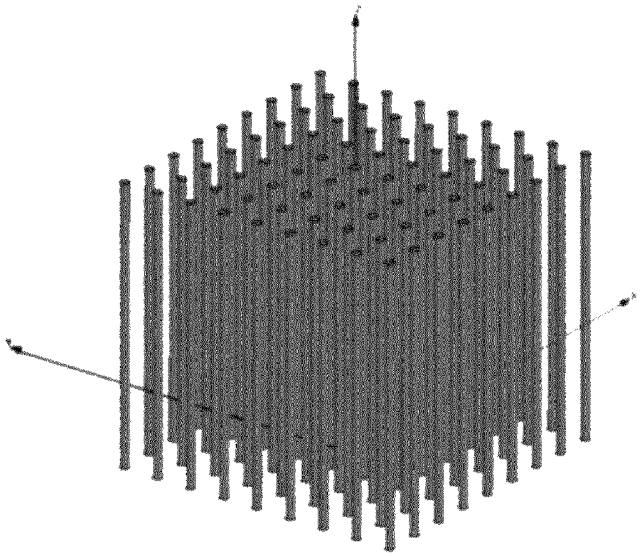
*Figure 2. Invisible material can be strengthened with wires, which are made with any material, for example with metal. Wires are placed inside the transmission line network so that they do not touch the transmission lines.*
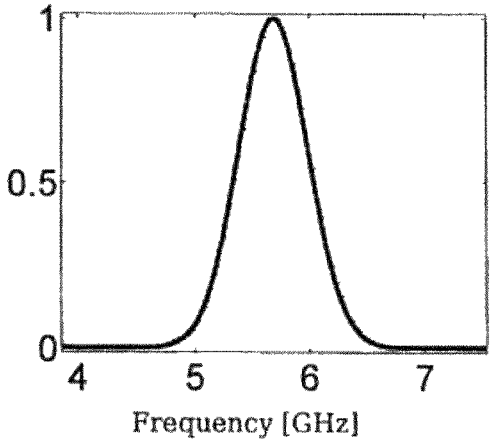
*Figure 3. Normalized electric field strength of the exitation field in FDTD simulations as a function of frequency.*

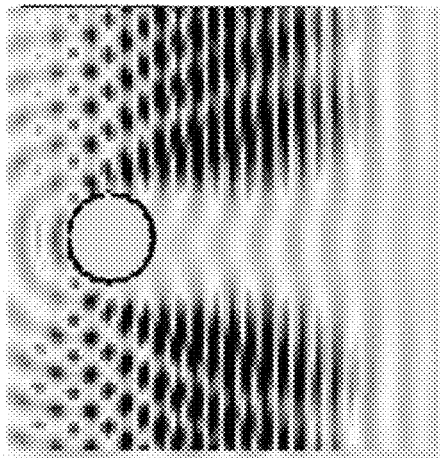

*Figure 4. A snap shot of the electric field strength from a wave pulse that has just passed a stack of electric wires. The wave pulse is coming from the left hand side.*

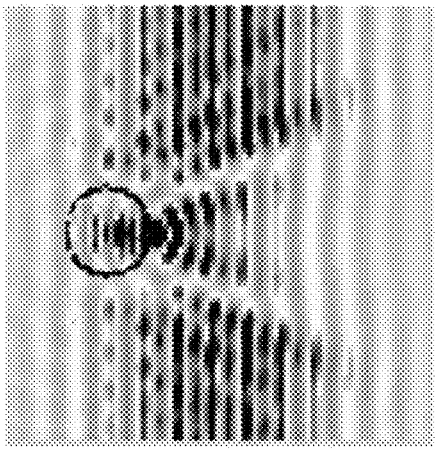

*Figure 5. A snap shot of the electric field strength of a pulse, which has just passed the invisibile material. Inside the material, there can be strengthening wires which would radiate as in Figure 4 without the invisible material around them.*

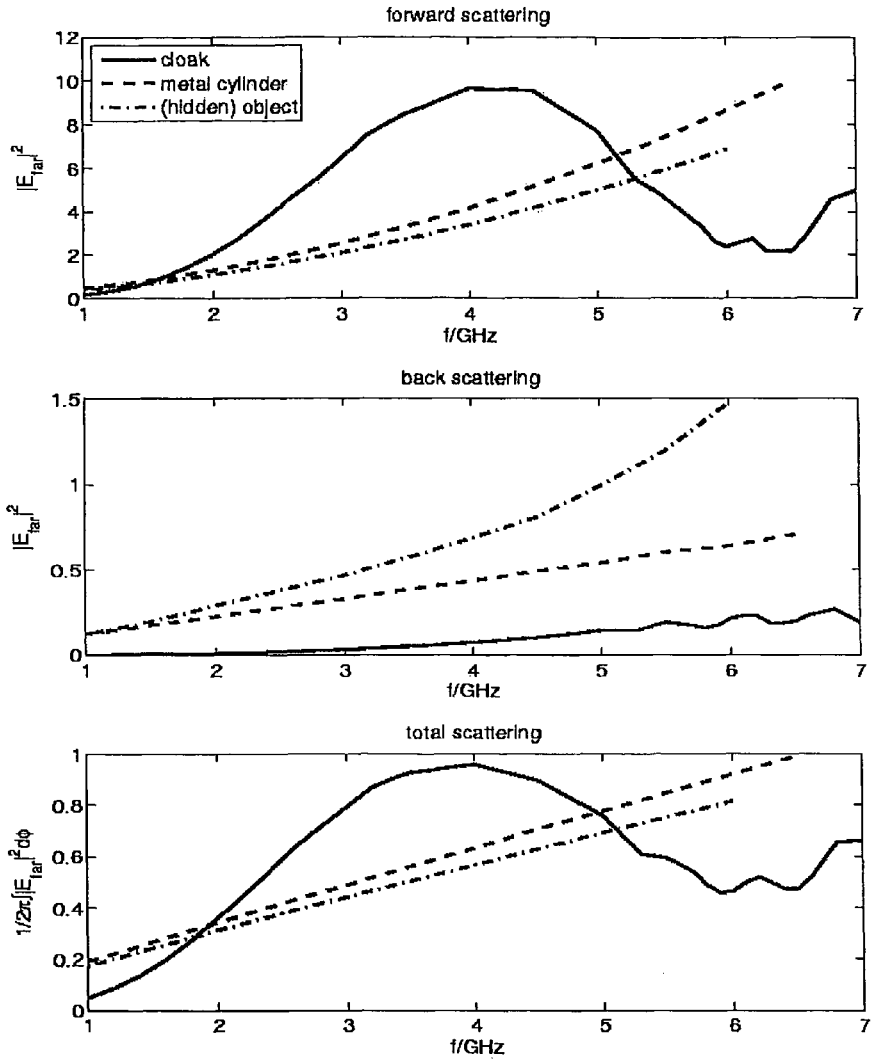

*Figure 6. From top down: forward scattering, back scattering and total scattering of the invisible cylinder a function of frequency. The scattering from invisible cylinder is marked with solid line. Dash-dotted lines corresponds to a stack of metallic wires which can be hidden inside the cylinder and dotted lines correspond to scattering from a solid metallic cylinder with the same size as the invisible cylinder. The invisible cylinder has a working frequency band near 6 GHz, where the total and forward scattering is reduced. The back scattering is highly reduced at all frequencies because of the impedance matching.*

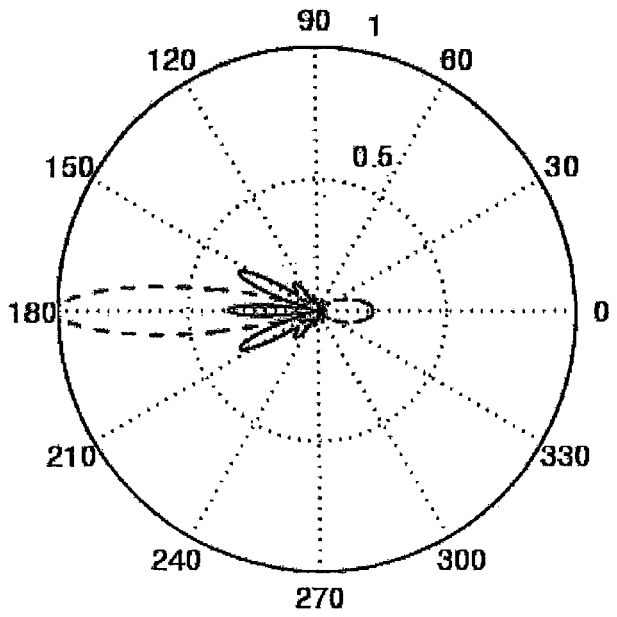
*Figure 7. The normalized scattering to different angles at the frequency of 6 GHz. The incident field is coming from direction 0. Red dashed line corresponds to a stack of cylinders without the invisible material around them and blue solid lines corresponds to the scattering of invisible cylinder.*

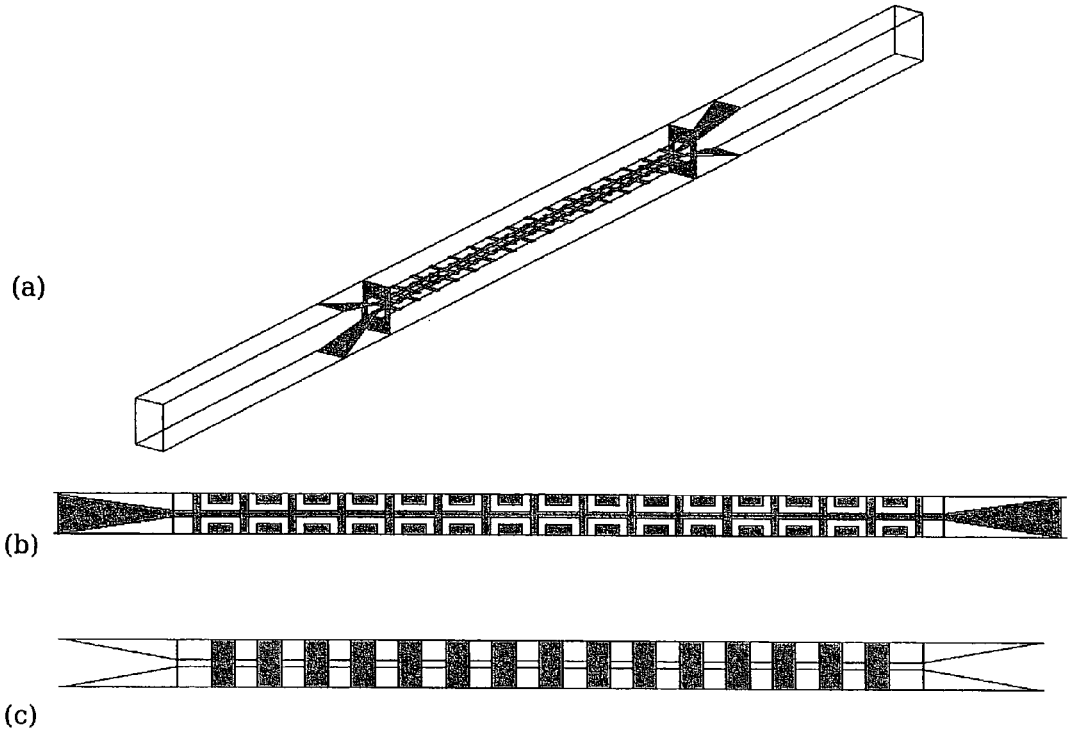

*Figure 8. (a) A section of slab of invisible material with matched horn antennas. The section is repeated to vertical and horizontal directions to form a slab of invisible material. The metallic wires which can be added to form a strong metallic structure are not shown. Figure (b) shows the top view of the design with the metallic wires inside the structure. The structure is repeated on the figure plane so that a rectangular mesh of orange wires is formed, which constructs the transmission line network. Rectangles between them are metallic wires added for the strengthening of the structure. Figure (c) shows the side view of the structure. Again the structure is infinite to top and down directions of the plane of the figure. Orange bulks mark the metallic wires, which are infinitely long.*

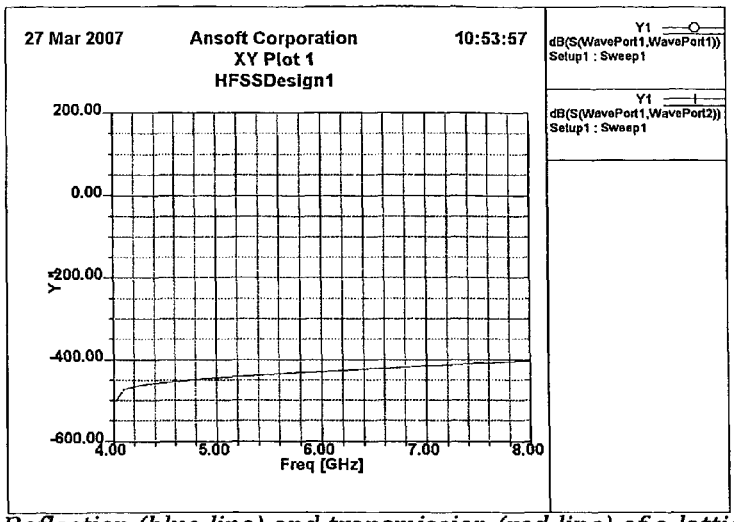

*Figure 9. Reflection (blue line) and transmission (red line) of a lattice of metallic wires in dB scale. Virtually all of the energy is reflected.*

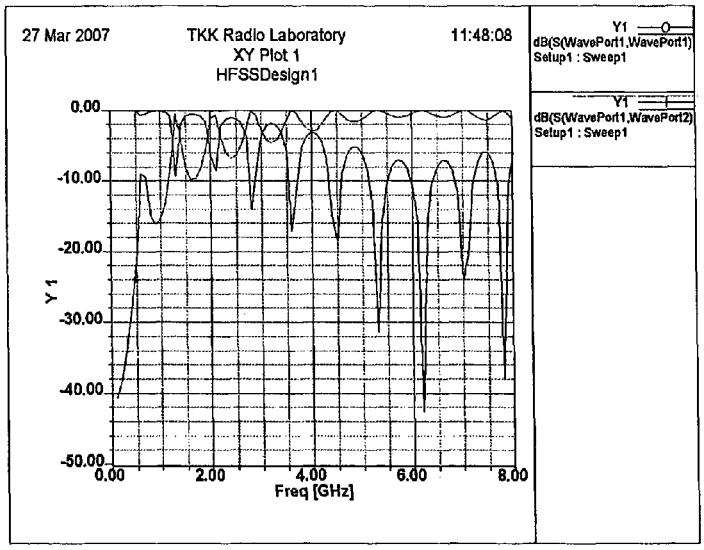

*Figure 10. The transmission (red line) and reflection (blue line) of the invisible material with metallic wires inside as a function of the frequency. Near the working frequency band of 6 GHz, the reflection is above -15 dB. Virtually all the energy passes the slab. Reflection and transmission for the same grid of metallic wires without the invisible material is shown in Figure 9.*

STRUCTURE FOR REDUCING SCATTERING OF ELECTROMAGNETIC WAVES

In this patent application, we describe an invisible structure and how it can be applied. The structure is invisible at the frequency band, where it is designed to work. In other words, the structure can be invisible at RF frequencies, but visually it can be seen.

BACKGROUND

Previously, invisibility devices have been invented for cloaking large objects [1-4] at or below the radio frequency range. There the cloak is a spherical object made with special material. Inside the cloak, there is a hole where the object which is made invisible is placed.

The drawback of these devices is, that it is very narrow band. Because of the narrow bandwidth, it does not work for signals.

Another related study involves reduction of forward scattering from cylindrical objects using hard surfaces [5]. There the wave is guided around the hided object. The device is broad-band, but works only for one angle of incidence. Therefore the radiation source can not be placed near the object which is made invisible. It can be used to hide struts from electromagnetic wave coming from one direction, but it can not be used to construct invisible supporting walls.

As far as we know, no-one has considered the advantage of invisible structure. Invisible structure can work for example as a supporting structure or as a mechanical shield, but still to be invisible for electromagnetic radiation. If an antenna is placed behind such an invisible structure, the radiation of the antenna can pass the structure freely. At the same time, the material can be a supporting structure or it can give a mechanical cover for the antenna. The novel structure is also broad band and it works for signals.

Wires can be placed inside the structure while maintaining the invisibility. For example the mechanical strength of the structure can be increased by adding metallic wires. Also electric wires can be placed inside the structure and still the material is invisible.

How Invisible Structure Works

Invisibility

The invisible structure passes the electromagnetic radiation through freely. It simulates free space, or any material surrounding it. In practice, there is always some un-idealities. Despite of this, the invisibility properties can be optimized for a desired application.

Reflection Free

The invisible structure minimizes the back scattering. This is because the invisible structure can be impedance matched with any surrounding material. For example ordinary window glass does have back scattering. This can be seen as mirror reflections from the window.

Mechanically Strong

The advantage of solid invisible structure is that it can be a part of a bigger construction. At the radio frequency range, materials which have the reflection constant near that of the free space are typically mechanically soft materials and they can not be used as supporting structures for heavy objects. The invisible structure can contain large amount of metallic wires, which makes it stronger than any ordinary material witch wave propagation properties close to air.

Broad Band

The invisible structure works for signals, because it is a broadband device. Real-life electromagnetic signals have always finite frequency band with. That is to say, signals have energy in a continuous range of frequencies. The invisible structure can be designed to work in a desired frequency band with. Then both the transmission line network and the matching layer are matched to work at this frequency band.

Two and Three-Dimensional Realizations

For a special use, the invisible structure can be simplified. Sometimes it might be enough to hide the structure from only one angle of incident and one polarization. In that case two dimensional invisibility is enough.

The invisible structure has two and three dimensional realizations. The three dimensional realization corresponds to three dimensional transmission-line network, which has three dimensional connections. Two dimensional network has connections in a plane.

CONSTRUCTION OF THE INVISIBLE STRUCTURE

Basic Design

An illustration of the invisible structure is presented in FIG. 1. The radiation from the source can pass the material freely.

Invisible structure construct of three parts:

1) A transmission line network, where transmission lines are connected either in 2D plane or in 3D space 2) A matching device on the boundary of the structure and the surrounding space 3) Any supporting structures which can be placed inside the transmission line network The matching device can be an antenna array between the surrounding space and the transmission-line network. The transmission line network simulates the surrounding space. The wave propagation is as close to the free space propagation as possible. The transmission line network is dense compared to the wavelength of the electromagnetic wave. Transmission lines are connected so that the wave can propagate freely to all directions inside the structure.

FIG. 1 presents a two-dimensional invisible structure. There transmission-lines have two-dimensional connections in the plane of the figure. A bulk material can be formed with a stack of these two-dimensional plates. In three dimensional transmission line network, the transmission lines of all layers in the stack would be also connected. The three-dimensional transmission line network forms a cubical mesh, whereas a two-dimensional network is a stack of square meshes or a single square mesh. One dimensional transmission line would be a single transmission line element between the matching devices.

Strengthened Structure

All three- two- and one-dimensional transmission line networks have holes between the transmission-line segments. In these holes, any material can be placed. Inside the structure, strengthening wires can be added. In FIG. 2. an illustration of a strengthening wire mesh, which can be placed inside the invisible structure is presented. Wires can be made with any material, also with metal. Normally this kind of wire mesh would be highly reflective, but the invisible material strengthened with wires is invisible.

The strengthening can be done with objects with arbitrary shape, as long as they fit inside the transmission line network. For example, wires in FIG. 2 could be connected between the transmission line segments sideways to form a single object. The strengthening can be a three dimensional mesh itself, as long as it fits inside the network.

Other Designs

Any material can be placed between the transmission lines. This can be applied for example to hide electric cables. For example in FIG. 2. wires can be both electric and supporting metallic wires.

Verification for Transmission Line Network

The transmission-lines and antennas can be freely chosen according to the application. The impedance match between the free space and the transmission line network can be achieved with a dense antenna array. In this section, the transmission line network is studied separately by assuming that it is surrounded with matched antennas. In the next section, it is shown, that antennas can be matched to the structure.

As an example, an invisible cylinder with metallic strengthening wires is studied. An illustration of the cylinder with the antenna array around it is presented in FIG. 1. The invisible structure is two dimensional. The cylinder is constructed with layers of transmission line networks. Along the cylinder, there is a mesh of metallic wires as presented in FIG. 2.

This structure is designed so that it is invisible for electromagnetic radiation which is parallel to the metallic wires. The other polarization is not that important from practical point of view. That polarization is not reflected strongly from a stack of thin metallic wires as presented in FIG. 2. The device is designed so that it minimizes both the forward and backward scattering from the wires. This structure could then be used to support any objects which need strong metallic wires. The scattering is highly reduced. The incident wave, to which the cylinder is invisible, can come from any direction to the cylinder.

The structure was studied with several independent numerical methods to verify the invisibility of the structure.

Time Domain Simulations

At first, a cylinder transmission line network was studied using FDTD method. There at the end of each transmission line element, there is a antenna which is assumed to be perfectly matched to the free space surrounding the cylinder. As a comparison, scattering from a lattice of metallic wires as in FIG. 2. was studied. This simulation demonstrates that the transmission line network is capable of reducing the scattering effectively for signals compared to a lattice of wires. Note that these wires can be placed inside the transmission line network which makes them invisible.

The invisible structure is constructed with transmission line network with periodicity of 8 mm. The diameter of the invisible cylinder is 12 cm. The structure is designed to work frequencies near 6 GHz.

In FIG. 3, the normalized electric field strength of the excitation field is presented as a function of frequency. In FIG. 4, a snap shot from the FDTD simulation is presented. There a pulse with frequency band as shown in FIG. 3 has just passed a cylinder object. The pulse propagates from left to right. The object is a stack of thin metallic wires. On the left hand side, there are circular waves. This is called "back scattering". On the right hand side, there is a long shadow. This is called "forward scattering".

The same lattice of metallic wires, which was simulated in FIG. 4, can be placed inside the invisible material. As a result, the invisible structure is mechanically as strong as the original lattice of wires. The transmission line network around the wires reduces scattering dramatically. In FIG. 5, a similar snapshot is shown as in FIG. 4. Now metallic wires are placed inside the invisible material. On the left hand side, the wave fronts are intact. This means that the back scattering is highly reduced. On the right hand side, wave fronts are formed again after some distance from the object. This means that the forward scattering is also reduced. Inside the cylinder, there can be seen wave fronts unlike in FIG. 4. The wave penetrates inside of the invisible material.

These simulations show, that the invisible structure highly reduces both forward and backward scattering for signal excitation compared to the reference object.

Frequency Domain Simulations

In addition to time domain simulation, the structure was studied with finite element based method with commercial software Comsol Multiphysics. In this case, the transmission line network was simulated as a homogeneous object with impedance matched to the free space. In that case a cylinder formed with transmission line section of certain inductance and capacitance, the structure is simplified to be formed with solid material with corresponding effective permittivity and permeability. The purpose of these simulation is to show independently from the previous method that if the antenna array can be matched to the transmission line network, the structure works as an invisible material.

In FIG. 6, the simulated forward, backward and total scattering as a function of frequency is presented. It can be seen, that near 6 GHz, there is a wide frequency band where both the total and forward scattering is reduced. The backward scattering is reduced with all frequencies because of the impedance matching. This verifies the result calculated with FDTD simulations, that the scattering is highly reduced around 6 GHz for the invisible cylinder.

In FIG. 7, the scattering to different angles is presented. The wave is coming from the angle 0. The solid line corresponds to the scattering from the invisible cylinder and the dashed line corresponds to the scattering from the wire mesh without the invisible material around them. Same result as in FIGS. 4-6 can be seen: the total, forward and backward scattering is highly reduced for the cylinder.

It is shown, that the transmission line network has significantly smaller scattering as a lattice of metallic wires. These wires can be placed inside the structure. As a result, the material is equally strong as the original stack of metallic wires, but its scattering is highly reduced.

Verification for the Antenna Array

The matching device around the transmission line network can be made with any antennas which are small enough to be connected with the transmission line network. They also need to be matched at the frequency band where the cylinder is made invisible. For this geometry, horn-type antennas were found to be suitable.

A section of the transmission line network with matched antennas and the metallic wire grid inside was simulated with HFSS software. The illustration of the transmission line network and antennas is presented in FIG. 8 (*a*). Around the simulated section of the transmission line section, mirroring boundary conditions were used. The simulated structure corresponds to a slab of invisible material between two arrays of horn antennas (2D invisible structure). Wires that are placed between the transmission lines are not shown in FIG. 8 (*a*). They are parallel to the surface of the invisible material slab. In Figure (b) and (c) top and side views of the structure are shown with the metallic wires inside.

As a comparison, a structure consisting of metallic wires without the transmission line network and antennas was studied. The reflection and transmission of a wave from the lattice of wires is shown in FIG. 9. Virtually all the energy is reflected from the surface of the wires.

In FIG. 10. the reflection and transmission of the slab of invisible material with the same metallic wires as in FIG. 9 is shown. Now instead of total reflection, almost all the energy propagates through the slab. The reflection around the working frequency of 6 GHz is below −15 dB.

PRIOR ART PATENTS AND PUBLICATIONS

As far as we know, there has been no attempts to create a structure, which is invisible itself. One reason is, that only recent advances in the area of metamaterial design has made it possible to even consider this possibility.

Prior art scientific publications related to invisibility devices [1-4] have very different purpose: they are designed to hide objects. In addition, they are too narrow band to work for signals. The realization is also very different.

Forward scattering has been reduced previously also using hard surfaces [5,6].

There a metallic cylinder can be made invisible using hard surface cover. The structure is broad band, but works only for single angle of incidence. The wave does not penetrate inside the hard surface cover. Therefore wall-like objects, where wave would travel through the invisible material, can not be constructed. Because the device works only for single angle of incidence, the source can not be placed near the object which is made invisible.

Strategic and Economical Issues

The invisible structure offers a novel material for any support or covering structure for any antenna application. It allows to construct large, solid and strong objects which are still invisible for electromagnetic radiation in a desired frequency band. Because there has been no such structures available, we believe that there is also economical interest for this innovation.

Examples of the Use

The new invisible structure can be used in many applications. For instance, for airport masts (supporting antennas etc.) it is important to minimize radar signal reflections from these structures. It is even more difficult problem for ships, especially military ships, because radars need to be positioned in a clattered environment among many metallic supports. These supports could be made "invisible" for radars with the use of our invention.

Another application example refers to the design of large reflector antennas, for instance, for radioastronomy. Here, the primary source (often, a horn antenna) should be positioned at the focal point of the reflector. Support structures (usually metal struts) reflect and scatter part of the radiated/received field, increasing the side-lobe level of the antenna. Our invention could dramatically modify the degrading effect of supporting struts on the antenna operation

CONCLUSIONS

It is shown numerically using several different frequency and time domain based electromagnetic simulation methods, that 1) The invisible material is broadband and therefore works for signals 2) Antenna array can be matched to the transmission line network 3) Inside the invisible material, metallic wires can be placed to mechanically strengthen the structure

REFERENCES

[1] J. B. Pendry, D. Schuring and D. R. Smith, "Controlling Electromagnetic Fields", Science Express, 1125907, May 2006.

[2] U. Leonhardt, "Optical Conformal Mapping", Science Express, Vol. 312, no. 5781, pp. 1777-1780, June 2006.

[3] D. Schuring, J. J. Mock, B. J. Justice, S. A. Cummer, J. B. Pendry, A. F. Star and D. R. Smith, "Metamaterial Electromagnetic Cloak at Microwave Frequencies", Science, Vol 314, pp. 977, November 2006.

[4] A. Cho, "News of the Week, Physics: High-Tech Materials Could Render Objects Invisible", Science, Vol. 312, May 2006.

[5] P. Kildal, A. Kishk and A. Tengs, "Reduction of Forward Scattering from Cylindrical Objects using Hard Surfaces", IEEE Transaction on Antennas and Propagation, Vol. 44, No. 11, pp. 1509-1520 November 1996

[6] Patent SE 9301521, (related to the ref. [5]). Describes struts which are made invisible using hard surfaces.

The invention claimed is:

1. A structure that is invisible to certain frequency bands, comprising:

a transmission line network comprised of a connected mesh of transmission lines; and a transition layer at a boundary of the structure;

wherein the transmission line network has been matched with a surrounding space.

2. The structure according to claim 1, characterized in that the structure minimizes scattering when it is designed as following:

the period of the transmission line network is smaller than a wavelength of the incident radiation;

the sites of the structure are chosen so that the scattering to the desired direction is minimized (the phase shift between the free space and the structure is minimized); and the transition layer has been dimensioned so that the incident (or incoming) power is transmitted in the transmission line network.

3. The structure according to claim 1, characterized in that the transmission line network is either one-, two- or three-dimensional.

4. The structure according to claim 1, characterized in that the transmission lines of the transmission line network have been connected with two-dimensional plane or with three-dimensional space.

5. The structure according to claim 1, characterized in that there is a transition device on the boundary of the structure which is an antenna arrangement between surrounding space and transmission line network.

6. The structure according to claim 1, characterized in that the invisible structure has been designed for a constant periodicity of transmission line network, advantageously 8 mm and that the diameter of the invisible cylinder is fixed, advantageously 12 cm and the structure is designed to work in frequencies near 6 GHz.

7. The structure according to claim 1, further comprising: supporting structures inside the transmission line network.

8. The structure according to claim 7, characterized in that the supporting structures are cylinders placed inside the transmission line network.

9. The structure according to claim 8, characterized in that the supporting cylinders are electrically conductive.

10. An assembly that is invisible to certain frequency bands, comprising:

a structure configured so that a radiation incident upon the structure passes freely through the material;

a transmission line network formed as a mesh of interconnected transmission lines;

supporting structures inside the transmission line network; and a transition device at a boundary of the transmission line network and a surrounding space, the transition device being in connection with the transmission line network, and the transmission lines of the transmission line network configured to propagate a wave from the incident radiation freely inside the structure.

11. The structure according to claim 10, wherein a period of the transmission line network is smaller than a wavelength of the radiation incident upon the structure, the radiation originating from a source at a distance and direction from the structure, and wherein a thickness of the structure is such that a scattering of the incident radiation is minimized.

12. The structure according to claim 10, wherein the supporting structures are wires placed between elements of the transmission line network.

13. The structure according to claim 10, wherein the transmission line network comprises transmission lines arranged in a two-dimensional mesh.

14. The structure according to claim 13, wherein the transmission line network comprises transmission lines arranged as a stack of said two-dimensional meshes connected with each other for form a three-dimensional mesh.

15. The structure according to claim 10, wherein the transition device is a plurality of antennas arranged along an outermost boundary portion of the transmission line network.

16. The structure according to claim 15, wherein the antennas of the transition device are metal strips with varying widths.

* * * * *